US010781740B2

(12) United States Patent
Röhr et al.

(10) Patent No.: US 10,781,740 B2
(45) Date of Patent: Sep. 22, 2020

(54) EXHAUST SYSTEM

(71) Applicant: Eberspächer Exhaust Technology GmbH & Co. KG, Neunkirchen (DE)

(72) Inventors: Benjamin Röhr, Esslingen (DE); Roland Schwarz, Esslingen (DE); Wolfgang Herbst, Rechberghausen (DE); Frank Berkemer, Eningen (DE); Tadeusz-Jozef Juroszek, Lichtenwald (DE); Peter Gorke, Stuttgart (DE)

(73) Assignee: Eberspächer Exhaust Technology GmbH & Co. KG, Neunkirchen (DE)

( * ) Notice: Subject to any disclaimer, the term of this patent is extended or adjusted under 35 U.S.C. 154(b) by 0 days.

(21) Appl. No.: 16/283,981

(22) Filed: Feb. 25, 2019

(65) Prior Publication Data

US 2019/0264597 A1 Aug. 29, 2019

(30) Foreign Application Priority Data

Feb. 26, 2018 (DE) ..... 10 2018 104 244

(51) Int. Cl.
*F01N 13/00* (2010.01)
*F01N 13/18* (2010.01)

(52) U.S. Cl.
CPC ..... *F01N 13/008* (2013.01); *F01N 13/1838* (2013.01)

(58) Field of Classification Search
CPC ..... F01N 13/008; F01N 13/1838
USPC ..... 73/866.5
See application file for complete search history.

(56) References Cited

U.S. PATENT DOCUMENTS 5,832,723 A * 11/1998 Iwata ..... F01N 13/008 60/276
8,235,592 B2 * 8/2012 Brautlgam ..... F16L 41/008 374/148
2001/0025419 A1 * 10/2001 Celerier ..... B21C 37/298 29/890.08
2003/0226412 A1 * 12/2003 Rumminger ..... F01N 13/008 73/866.5
2005/0155408 A1 * 7/2005 Weyl ..... G01K 1/14 73/23.31
2010/0158758 A1 * 6/2010 Gustin ..... F01N 13/008 422/83
2014/0060690 A1 3/2014 Jang
(Continued)

FOREIGN PATENT DOCUMENTS

DE 103 46 205 A1 9/2004
EP 2 703 615 A1 3/2014
(Continued)

*Primary Examiner* — Nimeshkumar D Patel
*Assistant Examiner* — Jean F Morello
(74) *Attorney, Agent, or Firm* — McGlew and Tuttle, P.C.

(57) ABSTRACT

An exhaust system, especially for an internal combustion engine in a vehicle, includes at least one sensor carrier unit (20) carried on an exhaust gas-carrying element (14). The sensor carrier unit (20) includes a sensor carrier element (22) fixed to the exhaust gas-carrying element (14). A plurality of sensor pipe connections (24, 26, 28), that are fitted or can be fitted with sensors, are provided on the sensor carrier element (22). The plurality of sensor pipe connections (24, 26, 28) each have at least one respective sensor-mounting/measuring opening (30) formed therein.

20 Claims, 4 Drawing Sheets

(56) References Cited

U.S. PATENT DOCUMENTS

| | | | | |
|---|---|---|---|---|
| 2014/0318228 | A1* | 10/2014 | Nomura | F01N 13/008 73/114.71 |
| 2015/0300233 | A1* | 10/2015 | Bowers | F01N 13/008 60/320 |
| 2015/0354431 | A1* | 12/2015 | Denis | F01N 13/008 73/866.5 |
| 2017/0081999 | A1 | 3/2017 | Lee et al. | |

FOREIGN PATENT DOCUMENTS

| | | | |
|---|---|---|---|
| EP | 2 868 887 | A1 | 5/2015 |
| FR | 2 925 586 | A3 | 6/2009 |

* cited by examiner

EXHAUST SYSTEM

CROSS REFERENCE TO RELATED APPLICATIONS

This application claims the benefit of priority under 35 U.S.C. § 119 of German Application 10 2018 104 244.2, filed Feb. 26, 2018, the entire contents of which are incorporated herein by reference.

TECHNICAL FIELD

The present invention pertains to an exhaust system for an internal combustion engine used, for example, in a motor vehicle.

BACKGROUND

Various sensors, for example, a temperature sensor detecting the exhaust gas temperature or one or more sensors detecting the composition of the exhaust gas, for example, a nitrogen oxide sensor, are provided in modern exhaust systems for providing information that is necessary to reduce the pollutant emission. Such sensors are provided, in general, at, for example, tubular, exhaust gas-carrying elements close to exhaust gas treatment systems, for example, an SCR catalytic converter device.

SUMMARY

An object of the present invention is to provide an exhaust system, with which it is made possible in a structurally simple manner to provide the information necessary for the operation of an exhaust system or of the internal combustion engine associated therewith.

This object is accomplished according to the present invention by an exhaust system, especially for an internal combustion engine in a vehicle, comprising at least one sensor carrier unit carried on an exhaust gas-carrying element, wherein the sensor carrier unit comprises a sensor carrier element fixed to the exhaust gas-carrying element and a sensor carrier element fixed to the exhaust gas-carrying element and, on the sensor carrier element, a plurality of, for example, three or at least three sensor pipe connections that are or can be fitted with sensors, each pipe connection being provided with at least one sensor-mounting/measuring opening formed therein.

In an exhaust system configured according to the present invention, it is made possible by the use of a single sensor carrier unit to provide a plurality of sensors on an exhaust system or on an exhaust gas-carrying element. This makes it possible to configure the associated sensor pipe connection with high precision in association with each individual sensor provided and to fix the sensor pipe connection to the exhaust gas-carrying element via the sensor carrier unit. Since the sensor pipe connection is not subject to any action during the fixation of the sensor carrier unit to the exhaust gas-carrying element, there is no risk in any of the plurality of sensor pipe connections to be provided that the sensor pipe connection will be damaged during the connection to the exhaust gas-carrying element or that the sensor pipe connection will be fixed in an unsuitable position especially in relation to other sensor pipe connections. Since it is not necessary to fix each sensor pipe connection individually to an exhaust gas-carrying element, the handling of the components to be connected to one another during the manufacture of an exhaust system is simplified. The time needed to manufacture an exhaust system can also be reduced, because the sensor carrier unit having a plurality of sensor pipe connections is introduced as a prefabricated assembly unit into the manufacturing process and can be connected to the exhaust gas-carrying element in a single operation.

To provide a connection between the exhaust gas-carrying element and the sensor carrier unit that is tight against the escape of exhaust gas in a reliable manner, it is proposed that the sensor carrier element have a sensor carrier element contour adapted to an outer circumferential contour of the exhaust gas-carrying element.

Provisions may be made in a configuration that can be manufactured in a simple manner for the sensor carrier element to be configured in one piece with at least one and preferably each sensor pipe connection. For example, the sensor carrier unit may be configured as a cast component.

In an alternative embodiment, the sensor carrier element has, in association with at least one and preferably each sensor pipe connection, a pipe connection contact plateau for contacting at least one sensor pipe connection formed separately from the sensor carrier element.

To make it possible to guarantee a defined positioning of a particular sensor pipe connection in relation to the sensor element, it is proposed that at least one and preferably each sensor pipe connection formed separately from the sensor carrier element comprise a positioning projection positioned such that it meshes with a positioning opening of the sensor carrier element. The positioning projection may surround the sensor-mounting/measuring opening formed in the sensor pipe connection with a ring-shaped configuration.

It is proposed for a stable connection of a respective sensor pipe connection to the sensor carrier element that a contact bead be provided for contacting the sensor pipe connection with the associated sensor contact plateau on at least one and preferably each sensor pipe connection formed configured separately from the sensor carrier element. The bead preferably surrounds the positioning projection formed on the sensor pipe connection with a ring-shaped configuration.

A connection of a respective sensor pipe connection to the sensor carrier element, which connection is stable under the thermal and mechanical loads occurring, can be obtained by at least one and preferably each sensor pipe connection formed configured separately from the sensor carrier element being connected to the sensor carrier element by welding, preferably by capacitor discharge welding.

The sensor carrier element may also be connected to the exhaust gas-carrying element by welding, preferably laser welding, MAG welding or capacitor discharge welding.

The sensor carrier element may be configured as a shaped sheet metal part in an embodiment that is also advantageous on the basis of the manufacturing costs.

Further, the present invention pertains to a sensor carrier unit, especially for an exhaust system configured according to the present invention, comprising a sensor carrier element to be fixed to an exhaust gas-carrying element and, on the sensor carrier element, a plurality of sensor pipe connections, which can be fitted with sensors and which have each at least one sensor-mounting/measuring opening formed in it. Such a sensor carrier unit may be configured with the individual features explained above or with any desired combination of the features explained above, which are specific for the sensor carrier unit.

The present invention will be described in detail below with reference to the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF PREFERRED EMBODIMENTS

Figure 1:
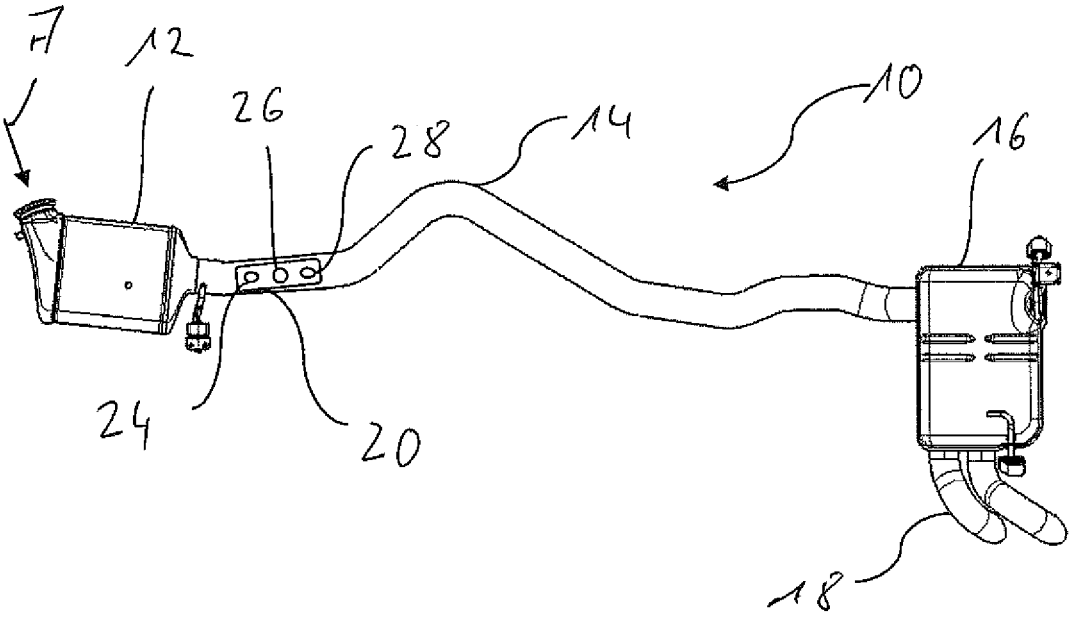
FIG. 1 is a plan view of an exhaust system for an internal combustion engine of a vehicle.

Referring to the drawings, an exhaust system for an internal combustion engine of a motor vehicle is generally designated by 10 in FIG. 1. The exhaust system 10 comprises in an upstream area an exhaust gas aftertreatment unit 12, for example, an SCR catalytic converter unit, into which the exhaust gas A discharged by an internal combustion engine is introduced. A tubular exhaust gas-carrying element 14 guides the exhaust gas discharged from the exhaust gas aftertreatment unit 12 to a muffler unit 16, which is arranged, for example, in a downstream end area of the exhaust system 10. The exhaust gas is discharged into the environment via tail pipes 18.

A sensor carrier unit 20, which will be described in detail below with reference to FIGS. 2 through 7, is provided in an area of the tubular exhaust gas guide element 14, which area adjoins, for example, the exhaust gas aftertreatment unit 12. The sensor carrier unit 20 comprises in the example being shown a sensor carrier element 22 configured, for example, as a shaped sheet metal part. The contour or shape of the sensor carrier element 22 is adapted to the contour of the exhaust gas guide element 14 in the area accommodating the sensor carrying unit 20. In the example shown, the elongated sensor carrier element 22 has a curved shape adapted to the, for example, circularly curved outer contour of the exhaust gas-carrying element 14.

Three sensor pipe connections 24, 26, 28, which are arranged such that they follow each other in a line, are provided on the elongated sensor carrier element 22 in the example being shown. Each sensor pipe connection 24, 26, 28 provides a sensor-mounting/measuring opening 30, into which a sensor can be inserted and through which the sensor can have a measuring interaction with the exhaust gas flowing in the exhaust gas-carrying element 14. The sensor-mounting/measuring opening 30 may be configured, for example, in at least some areas, with an internal thread 31, into which a corresponding external thread of the sensor to be mounted therein can be screwed, for a stable and gas-tight mounting of a sensor in a respective sensor-mounting/measuring opening 30. Adjacent to this internal thread area, a respective sensor-mounting/measuring opening 30 may have a ring-shaped bottom area 32, at which the sensor mounted therein can be supported via a, for example, O-ring-like sealing element or the like. To make it possible to provide the sensor-mounting pipe connections 24, 26, 28 with the required precision, these may be configured, for example, as metal components manufacturing, for example, by machining.

In association with each of the sensor pipe connections 24, 26, 28, a pipe connection contact plateau 34 is provided at the sensor carrier element 22. A positioning opening 36 is provided in each pipe connection contact plateau 34, which provides an essentially uncurved, flat contact area for a respective associated sensor pipe connection 24, 26, 28, for receiving a positioning projection 38, which is provided at the respective sensor pipe connections 24, 26, 28 and which surrounds the sensor-mounting/measuring opening in a ring-shaped or an essentially cylindrical configuration. The internal dimension of the positioning opening 36 and the outer dimensions of the positioning projection 38 may be coordinated with one another such that a nearly clearance-free meshing interaction, which thus predefines a defined positioning for a respective sensor pipe connection 24, 26, 28, is obtained.

The sensor pipe connections 24, 26, 28 are in contact with these respectively associated pipe connection contact plateaus 34 of the sensor carrier element 22 preferably via a contact bead 40 surrounding the positioning projection 38 or the sensor-mounting/measuring opening 30 in a ring-shaped configuration. A linear contact interaction, which extends over the entire circumference around the sensor-mounting/measuring opening, is thus obtained between a respective sensor pipe connection 24, 26, 28 and a respective pipe connection contact plateau 34. This is especially advantageous if the sensor pipe connections 24, 26, 28 with the sensor carrier element are to be connected to one another by capacitor discharge welding. Such a welding process is therefore especially advantageous because a connection of the sensor pipe connections 24, 26, 28 to the sensor carrier element 22, which is also very stable under the thermal loads and mechanical stresses to be expected during the operation of an internal combustion engine, is guaranteed. The sensor carrier unit 20 can be manufactured very easily with the use of such a welding process, because the components to be welded together, namely, the sensor pipe connections 24, 26, 28, on the one hand, and the sensor carrier element 22, on the other hand, can easily be pressed against each other with the use of corresponding tools in order to guarantee the contact pressure necessary for carrying out a capacitor discharge welding operation. Further, the use of such a capacitor discharge welding process leads to a nearly complete absence of weld warpage on the components to be connected to one another, so that these are available with the shape provided with high precision, which shape arises from the particular manufacturing process and is provided for the connection to the exhaust gas-carrying element 14, on the one hand, and for the mounting of sensors, on the other hand, even after the capacitor discharge welding process has been carried out.

The sensor carrier unit 20 having a plurality of sensor pipe connections 24, 26, 28 can be introduced in its entirety into the exhaust system manufacturing process, so that only a single connection operation is to be carried out during this manufacturing process in order to fix a plurality of sensor pipe connections 24, 26, 28 to the exhaust gas-carrying component 14 of the exhaust system 10. A connection by substance is preferably established by welding in this case as well. For example, a laser welding operation or a MAG welding operation, i.e., a protective gas welding operation, is preferably carried out to fix the plurality of sensor pipe connections 24, 26, 28 to the exhaust gas-carrying component 14 of the exhaust system 10. A comparatively high pressing pressure, as this is necessary in case of a capacitor discharge welding operation, is not necessary between the components to be welded together in such welding processes. Thus, there is no risk that the tabularly configured exhaust gas guide component 14 will be additionally weakened, in the area in which the sensor carrier unit 20 is to be fixed, due to an excessively high pressure or otherwise associated with the creation of an opening to be covered by the sensor carrier unit 20. A capacitor discharge welding operation may, of course, also be used to connect the sensor carrier unit 20 to the exhaust gas-carrying component 14, especially if there is access for corresponding supporting tools in the area of the exhaust gas-carrying component 14 or this exhaust gas-carrying component 14 is correspondingly stable because of its structural configuration.

Figure 2:
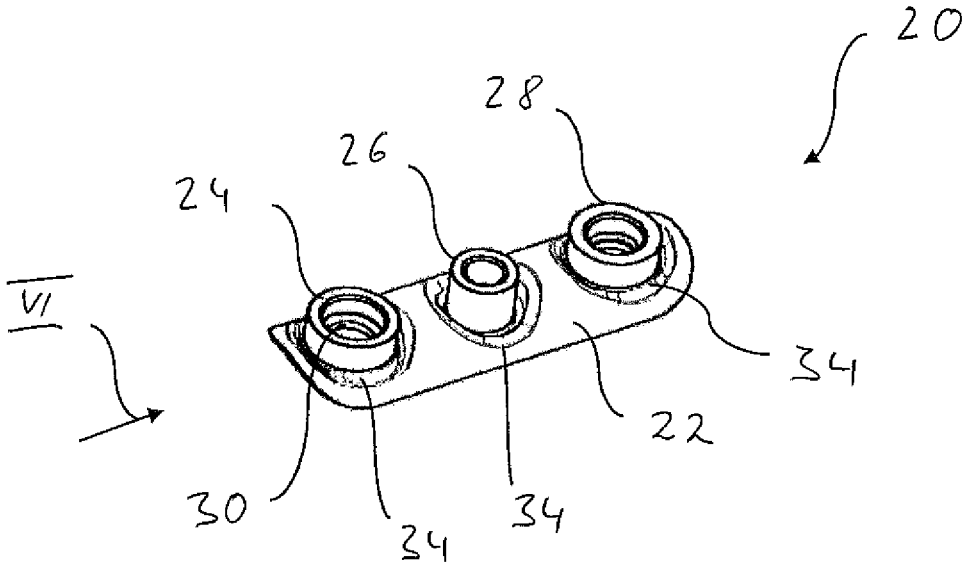
FIG. 2 is a perspective view showing a sensor carrier unit of the exhaust system according to FIG. 1.
Figure 3:
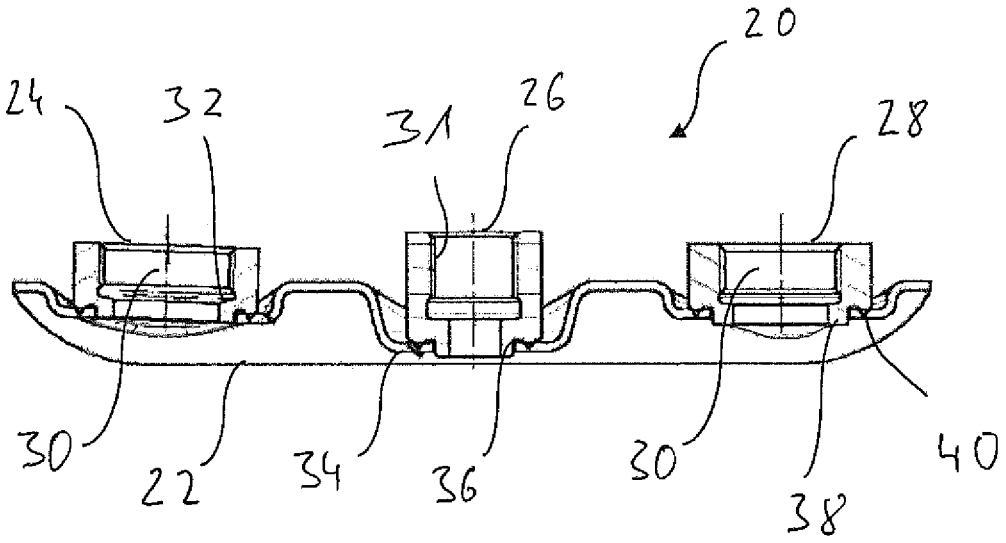
FIG. 3 is a longitudinal sectional view of the sensor carrier unit according to FIG. 2.
Figure 4:
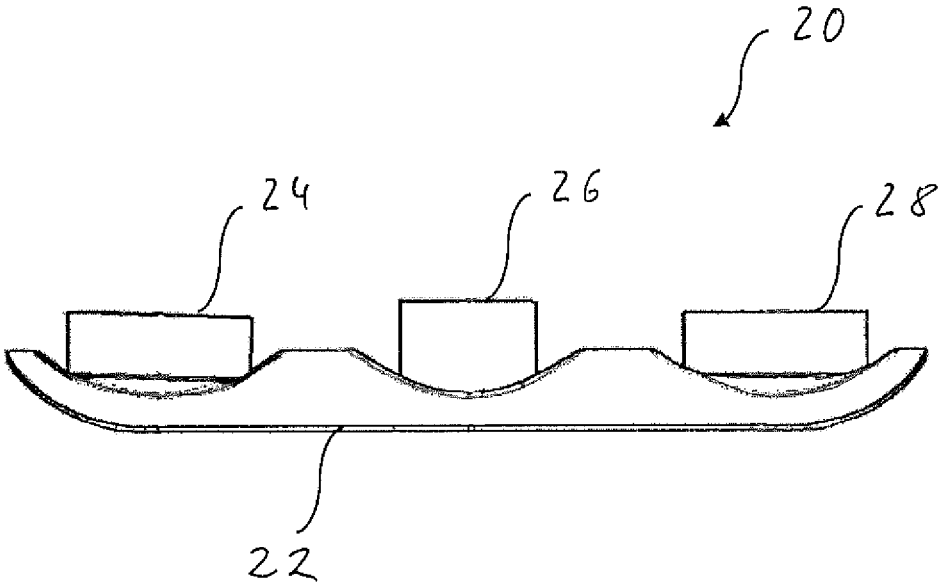
FIG. 4 is a lateral view of the sensor carrier unit according to FIG. 2.
Figure 5:
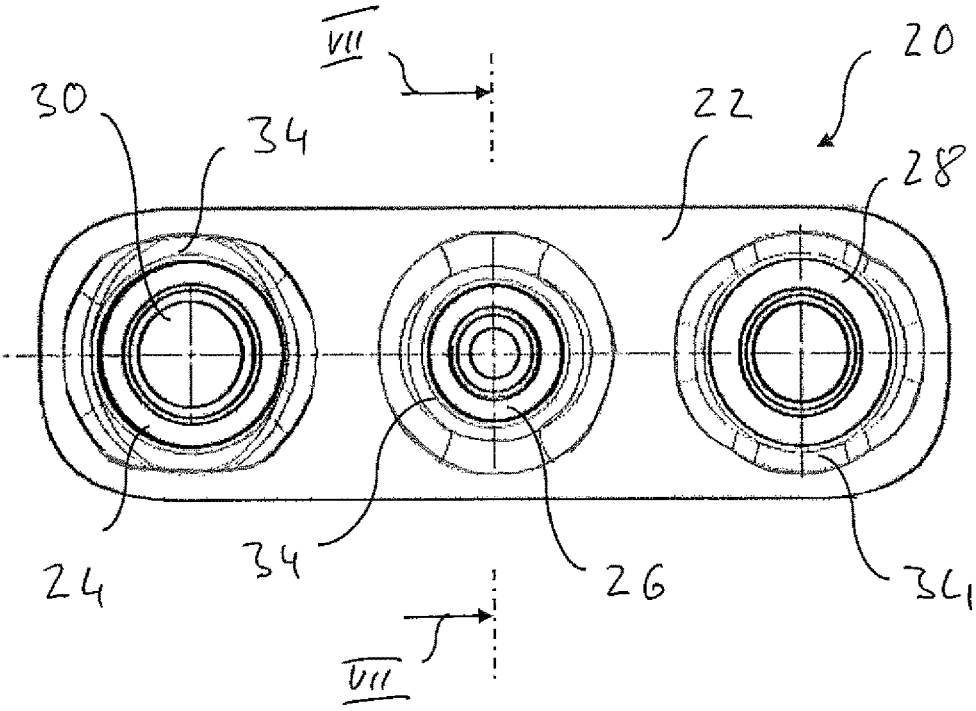
FIG. 5 is a top view of the sensor carrier unit according to FIG. 2.
Figure 6:
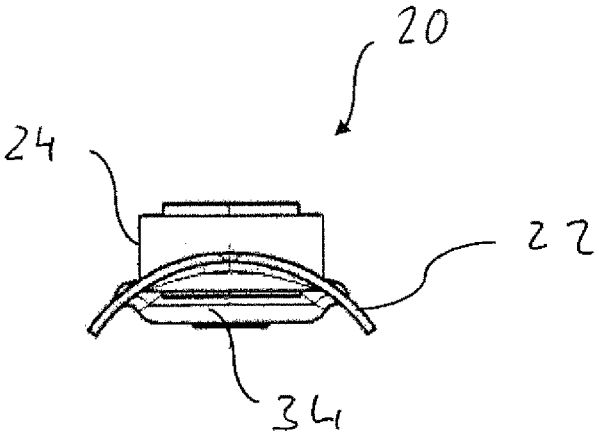
FIG. 6 is an end view of the sensor carrier unit according to FIG. 2 in the direction of view VI in FIG. 2.
Figure 7:
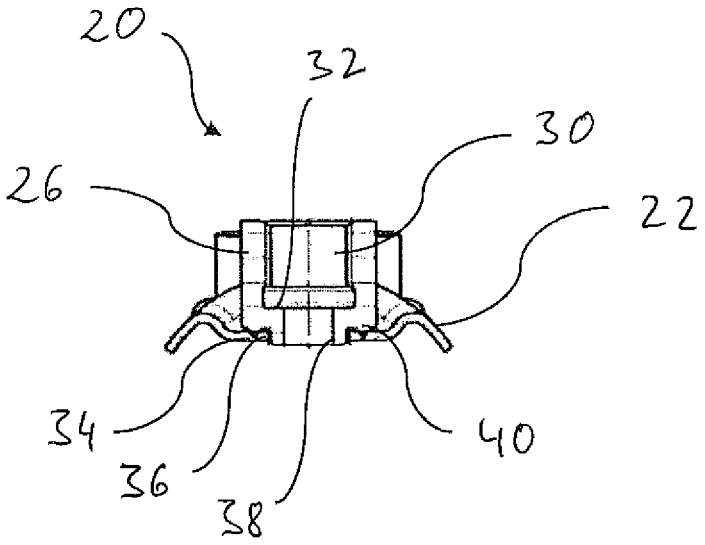
FIG. 7 is a cross-sectional view of the sensor carrier unit according to FIG. 2, cut along a line VII-VII in FIG. 5.

As is shown clearly above all in FIGS. 2 through 4, sensor pipe connections of various constructions may be provided on a sensor carrier unit 20 built according to the present invention in order to make it possible to correspondingly provide sensors of different configurations in an exhaust system. It should be noted that it is also possible, of course, to provide sensor pipe connections of identical configuration on a sensor carrier unit or/and that it is also possible, for example, to provide more than three sensor pipe connections or even only two sensor pipe connections on a sensor carrier unit. It would also be possible, in principle, to create the possibility of fixing a plurality of sensors in a single sensor pipe connection. A corresponding number of sensor-mounting/measuring openings associated with the sensors to be fixed to the sensor pipe connection could be provided for this in a single sensor pipe connection.

In another alternative embodiment, the sensor carrier unit could be provided as a one-piece structure, in which at least one of the sensor pipe connections is provided integrally with the sensor carrier element, i.e., as a material block, and is not fixed thereto as a separate component. For example, the sensor carrier unit with the sensor carrier element and with at least one of the sensor pipe connections can be provided in case of such a configuration as a cast component or possibly also as a shaped sheet metal part, on which the sensor pipe connections provided with an internal thread can be prepared by non-cutting shaping and possibly subsequent machining.

While specific embodiments of the invention have been shown and described in detail to illustrate the application of the principles of the invention, it will be understood that the invention may be embodied otherwise without departing from such principles.

What is claimed is:

1. An exhaust system for an internal combustion engine in a vehicle, the exhaust system comprising:

an exhaust gas-carrying element; and at least one sensor carrier unit carried on the exhaust gas-carrying element, wherein the sensor carrier unit comprises a sensor carrier element fixed to the exhaust gas-carrying element and a plurality of sensor pipe connections on the sensor carrier element, each of the plurality of sensor pipe connections having at least one respective sensor-mounting/measuring opening formed therein which are fitted or can be fitted with sensors, the sensor carrier element having a sensor carrier element contour adapted to an outer circumferential contour of the exhaust gas-carrying element, at least one of the plurality of sensor pipe connections being formed and configured separately from the sensor carrier element, the sensor carrier element having, in association with the at least one of the plurality of sensor pipe connections that is formed and configured separately from the sensor carrier element, a flat sensor pipe connection contact plateau for contacting the at least one of the plurality of sensor pipe connections that is formed and configured separately from the sensor carrier element.

2. An exhaust system in accordance with claim 1, wherein:

the sensor carrier element has at least one positioning opening; and the at least one of the sensor pipe connections formed and configured separately from the sensor carrier element comprises a positioning projection positioned to mesh with the at least one positioning opening of the sensor carrier element.

3. An exhaust system in accordance with claim 2, wherein the positioning projection surrounds the sensor-mounting/measuring opening formed in the sensor pipe connection with a ring-shaped configuration.

4. An exhaust system in accordance with claim 2, wherein a contact bead is provided on the at least one of the plurality of sensor pipe connections formed and configured separately from the sensor carrier element for contacting the sensor pipe connection with the associated sensor pipe contact plateau.

5. An exhaust system in accordance with claim 4, wherein the contact bead surrounds the positioning projection formed on the sensor pipe connection with a ring-shaped configuration.

6. An exhaust system in accordance with claim 1, wherein at least one sensor pipe connection formed and configured separately from the sensor carrier element is connected to the sensor carrier element by a weld connection, the at least one of the plurality of sensor pipe connections comprising a sensor pipe connection surface and a longitudinal axis, at least a portion of the sensor pipe connection surface radially overlapping at least a portion of the flat sensor pipe connection contact plateau with respect to the longitudinal axis, wherein the portion of the sensor pipe connection surface is in direct contact with the portion of the flat sensor pipe connection contact plateau.

7. An exhaust system in accordance with claim 1, wherein the sensor carrier element comprises a shaped sheet metal part.

8. An exhaust system in accordance with claim 1, wherein the sensor carrier element is connected to the exhaust gas-carrying element by weld connection.

9. An exhaust system sensor carrier element comprising:

a sensor carrier element configured to be fixed to an exhaust gas-carrying element; and a plurality of sensor pipe connections configured to be fitted with sensors, each of the plurality of sensor pipe connections having at least one respective sensor-mounting/measuring opening formed therein and each of the plurality of sensor pipe connections being disposed on the sensor carrier element, at least one of the plurality of sensor pipe connections being formed and configured separately from the sensor carrier element, the sensor carrier element having, in association with the at least one of the plurality of sensor pipe connections that is formed and configured separately from the sensor carrier element, a flat sensor pipe connection contact plateau for contacting the at least one of the plurality of sensor pipe connections that is formed and configured separately from the sensor carrier element.

10. An exhaust system sensor carrier element in accordance with claim 9, wherein the sensor carrier element has a sensor carrier element contour adapted to an outer circumferential contour of the exhaust gas-carrying element.

11. An exhaust system sensor carrier element in accordance with claim 9, wherein:

the sensor carrier element has at least one positioning opening;

the at least one of the plurality of sensor pipe connections formed and configured separately from the sensor carrier element comprises a positioning projection positioned to mesh with the at least one positioning opening of the sensor carrier element; and the positioning projection surrounds the sensor-mounting/measuring opening formed in the sensor pipe connection with a ring-shaped configuration.

12. An exhaust system sensor carrier element in accordance with claim 11, wherein:

a contact bead is provided on the at least one of the plurality of sensor pipe connections formed and configured separately from the sensor carrier element for contacting the sensor pipe connection with the associated sensor pipe contact plateau.

13. An exhaust system sensor carrier element in accordance with claim 11, wherein at least one sensor pipe connection formed and configured separately from the sensor carrier element is connected to the sensor carrier element by a weld connection.

14. An exhaust system sensor carrier element in accordance with claim 9, wherein the sensor carrier element comprises a shaped sheet metal part, the at least one of the plurality of sensor pipe connections comprising a sensor pipe connection surface and a longitudinal axis, at least a portion of the sensor pipe connection surface radially overlapping at least a portion of the flat sensor pipe connection contact plateau with respect to the longitudinal axis, wherein the portion of the sensor pipe connection surface is in direct contact with the portion of the flat sensor pipe connection contact plateau.

15. An exhaust system sensor carrier element comprising:

a sensor carrier element configured to be fixed to an exhaust gas-carrying element; and a plurality of sensor pipe connection structures configured to be fitted with sensors, each of the plurality of sensor pipe connection structures having at least one respective sensor-mounting/measuring opening formed therein and each of the plurality of sensor pipe connection structures being disposed on the sensor carrier element, the at least one of the plurality of sensor pipe connection structures comprising a sensor pipe connection structure longitudinal axis and a sensor pipe connection structure circumferentially extending portion, the sensor carrier element comprising a planar sensor carrier element circumferentially extending portion, at least a portion of the planar sensor carrier element circumferentially extending portion radially overlapping at least a portion of the sensor pipe connection structure circumferentially extending portion with respect to the sensor pipe connection structure longitudinal axis, wherein the portion of the planar sensor carrier element circumferentially extending portion is in direct contact with the portion of the sensor pipe connection structure circumferentially extending portion.

16. An exhaust system sensor carrier element in accordance with claim 15, wherein the planar sensor carrier element circumferentially extending portion comprises a sensor carrier element surface defining at least a portion of a sensor carrier element opening, at least a portion of the at least one of the plurality of sensor pipe connection structures being arranged in the sensor carrier element opening, the portion of the at least one of the plurality of sensor pipe connection structures being located at a spaced location from the sensor carrier element surface.

17. An exhaust system sensor carrier element in accordance with claim 15, wherein the sensor carrier element has a sensor carrier element contour corresponding to an outer circumferential contour of the exhaust gas-carrying element.

18. An exhaust system sensor carrier element in accordance with claim 15, wherein:

the sensor carrier element has at least one positioning opening;

the at least one of the plurality of sensor pipe connection structures formed and configured separately from the sensor carrier element comprises a positioning projection positioned to mesh with the at least one positioning opening of the sensor carrier element; and the positioning projection surrounds the sensor-mounting/measuring opening formed in the sensor pipe connection structure with a ring-shaped configuration.

19. An exhaust system sensor carrier element in accordance with claim 18, wherein:

a contact bead is provided on the at least one of the plurality of sensor pipe connection structures formed and configured separately from the sensor carrier element for contacting the sensor pipe connection structure with the planar sensor carrier element circumferentially extending portion.

20. An exhaust system sensor carrier element in accordance with claim 18, wherein at least one sensor pipe connection structure formed and configured separately from the sensor carrier element is connected to the sensor carrier element by a weld connection, wherein the sensor carrier element comprises a shaped sheet metal part.

* * * * *